US009884493B2

(12) United States Patent
Mimoto et al.

(10) Patent No.: US 9,884,493 B2
(45) Date of Patent: Feb. 6, 2018

(54) IMAGE RECORDING APPARATUS

(71) Applicant: Brother Kogyo Kabushiki Kaisha, Nagoya-shi, Aichi-ken (JP)

(72) Inventors: Masao Mimoto, Nagoya (JP); Shingo Ito, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/865,702

(22) Filed: Sep. 25, 2015

(65) Prior Publication Data

US 2016/0089899 A1 Mar. 31, 2016

(30) Foreign Application Priority Data

Sep. 25, 2014 (JP) ..... 2014-195066

(51) Int. Cl.
*B41J 2/015* (2006.01)
*B41J 11/00* (2006.01)

(52) U.S. Cl.
CPC ..... *B41J 11/005* (2013.01)

(58) Field of Classification Search
None
See application file for complete search history.

(56) References Cited

U.S. PATENT DOCUMENTS

2003/0052956 A1* 3/2003 Katsuyama ..... B41J 13/103 347/108
2009/0008865 A1* 1/2009 Miyamoto ..... B65H 3/0684 271/109
2011/0249068 A1* 10/2011 Terada ..... B65H 5/062 347/104

FOREIGN PATENT DOCUMENTS

JP 2000-071532 A 3/2000

* cited by examiner

*Primary Examiner* — Erica Lin
(74) *Attorney, Agent, or Firm* — Banner & Witcoff, Ltd.

(57) ABSTRACT

An image recording apparatus includes: a recording section configured to record an image on a sheet conveyed in a conveyance direction in a conveyance route; and an abutment member having a plurality of abutment portions which are arranged apart from each other in a width direction orthogonal to the conveyance direction so that the plurality of abutment portions abut against the sheet convened in the conveyance route respectively, and a connecting portion connecting adjacent abutment portions among the plurality of abutment portions. The connecting portion twists so as to rotate with the width direction as a rotation axis, under a condition that the plurality of abutment portions abuts against the sheet.

17 Claims, 8 Drawing Sheets

IMAGE RECORDING APPARATUS

CROSS REFERENCE TO RELATED APPLICATION

The present application claims priority from Japanese Patent Application No. 2014-195066 filed on Sep. 25, 2014 the disclosure of which is incorporated herein by reference in its entirety.

BACKGROUND

Field of the Invention

The present invention relates to an image recording apparatus which causes a sheet on which an image is recorded to be in a desired waved state.

Description of the Related Art

Conventionally, there is known an ink-jet recording apparatus which jets ink droplets onto a sheet such as a recording paper from nozzles provided in a recording unit so as to record an image, etc. on the sheet. In the ink-jet recording apparatus, a supporting member such as a platen is arranged to support the sheet at a position facing the recording unit. When the sheet is conveyed onto the supporting member, the sheet is supported by the supporting member in a state that the sheet faces the recording unit, and the ink droplets are selectively discharged from the recording unit onto the sheet, thereby recording an image, etc. on the sheet.

In the ink-jet recording apparatus as described above, a phenomenon (cockling) occurs in some cases; the cockling is such a phenomenon that a portion of the sheet onto which the ink is adhered swells and floats from the supporting member. In a case that the cockling occurs, the portion of the sheet floated from the supporting member makes contact with the recording unit, and/or makes contact with a guide member, which in turn may cause distortion of the recorded image and/or any clogging of the sheet.

In order to solve the above-described problem, there is known a structure to cause a sheet (recording sheet material), which is being conveyed on a supporting member (platen) in a conveyance direction, to be in a waved state in a width direction of the sheet orthogonal to the conveyance direction. Specifically, the conventional structure includes a plurality of ribs and a recording-sheet pressing plate. The ribs are arranged in a conveyance surface of the platen to be parallel to the conveyance direction. The recording-sheet pressing plate has a plurality of projections configured to press portions of the recording sheet into recesses which are defined between the adjacent ribs, respectively. Because the ribs of the platen and the projections of the recording-sheet pressing plate abut against the sheet alternately in the width direction, the sheet is caused to be in the waved state in the width direction.

SUMMARY

In the conventional structure, the plurality of projections in the recording-sheet pressing plate are formed integrally. Here, the widths of sheets which are conveyed in the ink-jet recording apparatus for the purpose of recording an image, etc. are various. For example, when an A5-sized sheet is conveyed in an ink-jet recording apparatus capable of conveying an A3-sized sheet with the center in the width direction as the reference of the conveyance, projections located at the center portion in the width direction of the recording-sheet pressing plate make abut against the A5-sized sheet. However, projections located at the both sides in the width direction of the recording-sheet pressing plate do not abut against the A5-sized sheet. In such a situation, when certain projections abutting against the A5-sized sheet are elastically deformed due to the reaction force from the sheet, other projections, which are adjacent to the certain projections and which do not abut against the A5-sized sheet, are also deformed to some extent via a connecting portion between the projections. When such a force deforming even the projections which do not abut against the sheet is also applied to the sheet, the force not required for causing the sheet to be in the desired waved state is also applied to the sheet, which in turn may not cause the sheet to be in an ideal waved state. On the other hand, when the respective projections are molded independently as separate components or parts, there is such an inconvenience that an operation for installing the respective projections might become complex and/or that the shape of the respective projections might be easily unstable.

The present teaching has been made in view of the above-described circumstances; an object of the present teaching is to provide an image recording apparatus which causes a sheet, on which an image, etc. is recorded, to be in a desired waved state by an abutment member having a plurality of abutment portions.

According to an aspect of the present teaching, there is provided an image recording apparatus including: a recording section configured to record an image on a sheet conveyed in a conveyance direction in a conveyance route; and an abutment member having a plurality of abutment portions which are arranged apart from each other in a width direction orthogonal to the conveyance direction so that the plurality of abutment portions abut against the sheet convened in the conveyance route respectively, and a connecting portion connecting adjacent abutment portions among the plurality of abutment portions, wherein the connecting portion is configured to twist so as to rotate with the width direction as a rotation axis under a condition that the plurality of abutment portions abuts against the sheet.

With such a structure, in a case that only one of abutment portions on the both sides of the connecting portion abuts against the sheet, the twist of the connecting portion suppresses any deformation of the other abutment portion.

According to the present teaching, the plurality of abutment portions abuts against the sheet so that the sheet is caused to be in a desired waved state.

DESCRIPTION OF THE EMBODIMENTS

In the following, an embodiment of the present teaching will be explained with reference to the drawings as appropriate. Note that, however, the embodiment described below is merely an example of the present teaching; it goes without saying that it is possible to make any appropriate changes in the embodiment of the present teaching without departing from the gist and scope of the present teaching. In the following explanation, an up-down direction 7 is defined with a state that a multifunction peripheral 10 is usably placed (usable state; state depicted in FIG. 1), as the reference; a front-rear direction 8 is defined with a front surface side of the multifunction peripheral 10 as the frontward side; and a left-right direction 9 is defined as viewing the multifunction peripheral 10 from the frontward side (near side).

Entire Structure of Multifunction Peripheral 10

Figure 1:
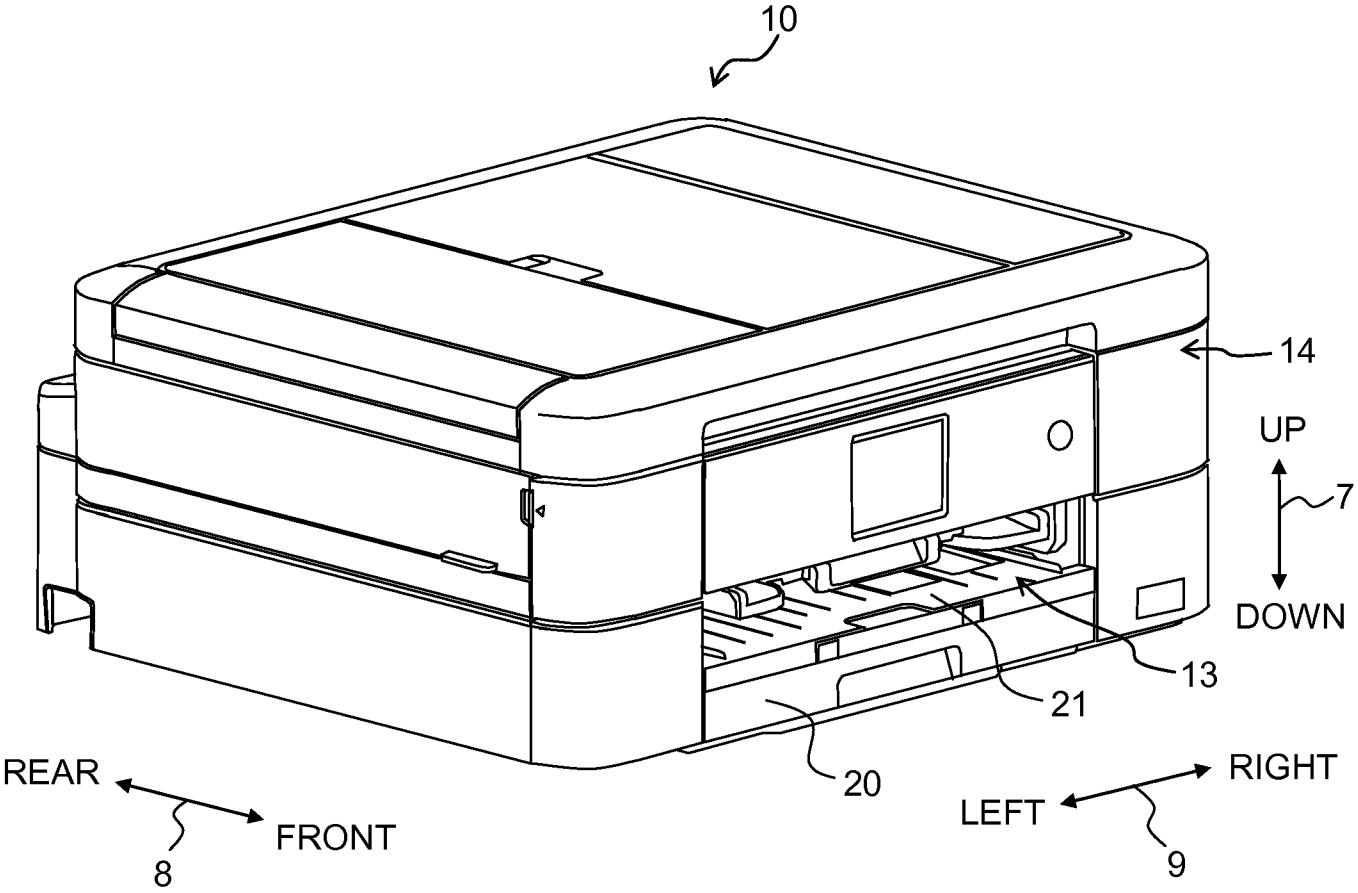
FIG. 1 is a perspective view of a multifunction peripheral as an example of an embodiment of the present teaching.

The multifunction peripheral 10 depicted in FIG. 1 (an example of an image recording apparatus of the present teaching) has various functions such as a facsimile function and a print function. The multifunction peripheral 10 has a casing 14 which is formed to have a substantially rectangular parallelepiped shape of a thin type, and a feeding tray 20 which is attached in the casing 14 at a lower portion thereof. The feeding tray 20 is configured such that the feeding tray 20 can be drawn frontward from the casing 14.

A discharge space 13 is defined inside the casing 14 at a position above a front portion of the feeding tray 20 attached to the casing 14. A recording sheet 12 on which an image has been recorded is discharged to the discharge space 13. The discharge space 13 is open in the front side thereof. A discharge tray 21 for placing the recording sheet 12 (see FIG. 2) on which the image has been recorded is provided at a position below the discharge space 13. The discharge tray 21 is supported on the feeding tray 20.

Figure 2:
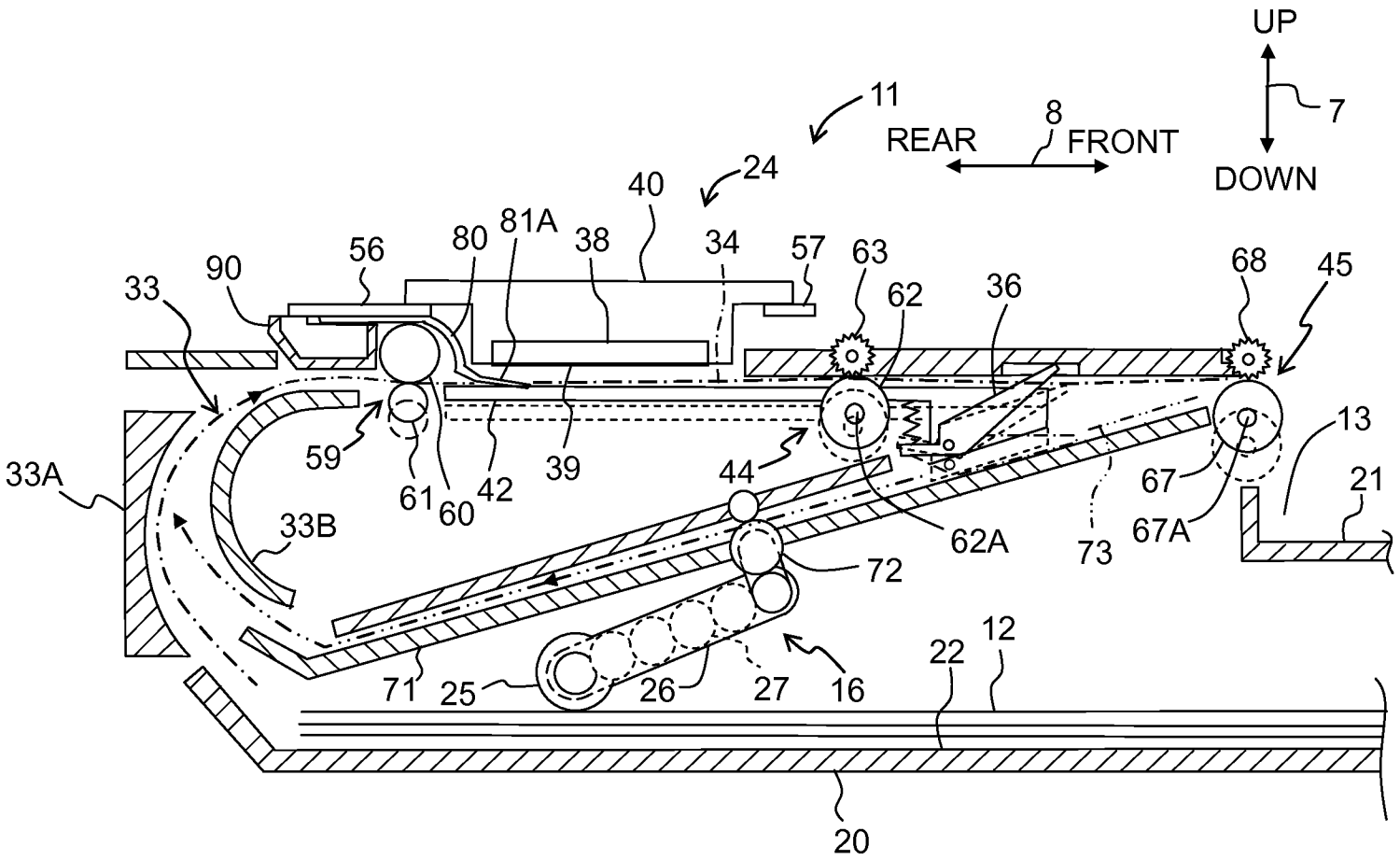
FIG. 2 is a cross-sectional view schematically depicting the structure of a printer unit.

As depicted in FIG. 2, a printer unit 11 is provided inside the casing 14 at an upper portion on the rear side thereof. The printer unit 11 records an image, etc. on a recording medium such as the recording sheet 12, by an ink-jet system. The feeding tray 20 is provided with a supporting surface 22 on which a plurality of recording sheets 12 are stacked in the up-down direction 7. The multifunction peripheral 10 has a function of recording an image, etc., on one surface of each of the recording sheets 12 stacked on the supporting surface 22 of the feeding ray 20, and a function of recording an image, etc., on both surfaces of each of the recording sheets 12. Further, the multifunction peripheral 10 also has a function of recording an image, etc., on a disc surface of a recording medium such as a CD-ROM, DVD-ROM, etc.

A feeding section 16 which feeds the recording sheets 12 inside the feeding tray 20 to the printer unit 11 is disposed below the printer unit 11. The feeding section 16 has a feeding roller 25 which abuts against an uppermost recording sheet 12 inside the feeding tray 20 and feeds the uppermost recording sheet 12 in a rearward and upward direction. The feeding roller 25 is supported by a supporting arm 26 to be rotatable between an abutment position at which the feeding roller 25 abuts against the uppermost recording sheet 12 in the feeding tray 20 and a separate position at which the feeding roller 25 is separated away in an upward direction from the recording sheet 12. A driving force from an unillustrated motor is transmitted to the feeding roller 25 by a driving force transmitting mechanism 27.

A first conveyance route 33 via which a recording sheet 12 fed from the feeding tray 20 by the feeding section 16 is conveyed upward is provided at a rear portion of the casing 14. The first conveyance route 33 has an arc shape protruding rearward by an outer circumferential guide member 33A located on the rear side and an inner circumferential guide member 33B located on the front side. The recording sheet 12 conveyed in the first conveyance route 33 is conveyed based on such a center reference that the center in the width direction, which is orthogonal to the conveyance direction, of the recording sheet 12 is substantially coincident with the center in the width direction of the first conveyance route 33.

The recording sheet 12 fed from the feeding tray 20 enters into the first conveyance route 33 from an lower end of the first conveyance route 33, and is discharged from an upper end of the first conveyance route 33 in the forward direction. A second conveyance route 34, via which the recording sheet 12 conveyed through the first conveyance route 33 is conveyed in the forward direction, is disposed along the front-rear direction 8 at an upper location in the printer unit 11. The second conveyance route 34 extends from the upper end of the first conveyance route 33 and arrives at a location above a rear end portion of the discharge tray 21.

The second conveyance route 34 is provided with a first conveyance roller pair 59, a platen 42, a second conveyance roller pair 44, a route switching mechanism 36, and a reversing roller pair 45 in this order forwardly in the rear-right direction 8, and each of the first conveyance roller pair 59, the platen 42, the second conveyance roller pair 44, the route switching mechanism 36, and the reversing roller pair 45 constructs a part of the second conveyance route 34. The recording sheet 12 is conveyed based on the center reference also in the second conveyance route 34.

The first conveyance roller pair 59 includes a first conveyance roller 60 which is arranged on the upper side in the pair and a pinch roller 61 which is arranged on the lower side in the pair. In a case that the recording sheet 12 is conveyed in the second conveyance route 34, the first conveyance roller 60 is driven and rotated in a state that the first conveyance roller 60 is brought into pressurized contact with the pinch roller 61.

The platen 42 arranged between the first conveyance roller pair 59 and the second conveyance roller pair 44 supports the recording sheet 12 which is being conveyed in the second conveyance route 34 in a state that the recording sheet 12 is along the front-rear direction 8. A recording section 24 which records an image, etc. on the recording sheet 12 supported by the platen 42 is provided above the platen 42. The recording section 24 forms the image, etc. with respect to the recording sheet 12 which has been conveyed based on the center reference and which is supported on the platen 42, with the center position in the width direction of the recording sheet 12 as the reference.

The recording section 24 is supported by a first guide rail 56 and a second guide rail 57. The first guide rail 56 and the second guide rail 57 are disposed above the platen 42 along the left-right direction 9 in a state of being apart from each other in the front-rear direction 8. The recording section 24 has a carriage 40 slidably supported by the first and second guide rails 56 and 57, and a recording head 38 arranged at a lower portion of the carriage 40. The recording head 38 is provided with a plurality of nozzles 39 which discharge an ink downward from a plurality of discharge ports, respectively. The ink is supplied to the nozzles 39 from an ink cartridge (not depicted in the drawings).

The second conveyance roller pair 44 arranged in front of the platen 42 includes a second conveyance roller 62 arranged on the lower side in the pair and a facing roller (following roller) 63 arranged on the upper side in the pair. In a case that the recording sheet 12 is conveyed, the second conveyance roller 62 is driven and rotated in a state that the second conveyance roller 62 is brought into pressurized contact with the facing roller 63.

In a case that the recording sheet 12 conveyed by the second conveyance roller pair 44 abuts against the route switching section 36, the route switching section 36 is in such a state that the recording sheet 12 can pass above the route switching section 36. Further, as will be described later on, in a case that the conveyance direction of the recording sheet 12, guided toward the reversing roller pair 45 by the route switching section 36, is reversed by the reversing roller pair 45 so that the recording sheet 12 is conveyed in a rearward direction, the recording sheet 12 abuts against the route switching section 36, which in turn causes the recording sheet 12 to be guided to the lower side of the route switching section 36.

The reversing roller pair 45 includes a reversing roller 67 which is arranged on the lower side in the pair and a facing roller (following roller) 68 which is arranged on the upper side in the pair. The reversing roller 67 is rotatable in each of the normal and reverse directions. The facing roller 68 rotates following rotation of the reversing roller 67 in a state that the facing roller 68 is brought into pressurized contact with the reversing roller 67.

Regarding the rotational direction of the reversing roller 67, the rotation of the reversing roller 67 in a case that the recording sheet 12 is conveyed in the forward direction is referred to as "normal rotation", and the rotation of the reversing roller 67 in a case that the recording sheet 12 is conveyed in the rearward direction is referred to as "reverse rotation". In a case that an image is to be recorded only on one surface of the recording sheet 12, the reversing roller 67 is subjected to the normal rotation, and the recording sheet 12 conveyed by the reversing roller pair 45 is discharged onto the discharge tray 21.

On the other hand, in a case that an image or images is/are to be recorded on the both surfaces of the recording sheet 12, the reversing roller 67 is subjected to the normal rotation, and after the recording sheet 12 having the image recorded on one surface thereof is conveyed until immediately before the rear end portion of the recording sheet 12 passes through the reversing roller pair 45, the reversing roller 67 is subjected to the reverse rotation. With this, the recording sheet 12 is conveyed in the rearward direction toward the route switching section 36, and is guided to the lower side of the route switching section 36. A branching conveyance guide 71 is disposed below the route switching section 36, and a third conveyance route 73 is formed by the branching conveyance guide 71. The branching conveyance guide 71 extends from the reversing roller pair 45 to the lower end portion of the first conveyance route 33. The recording sheet 12 conveyed along the branching conveyance guide 71 is conveyed to the lower end portion of the first conveyance route 33 by an intermediate conveying roller pair 72.

<Printer Unit 11>

Figure 3:
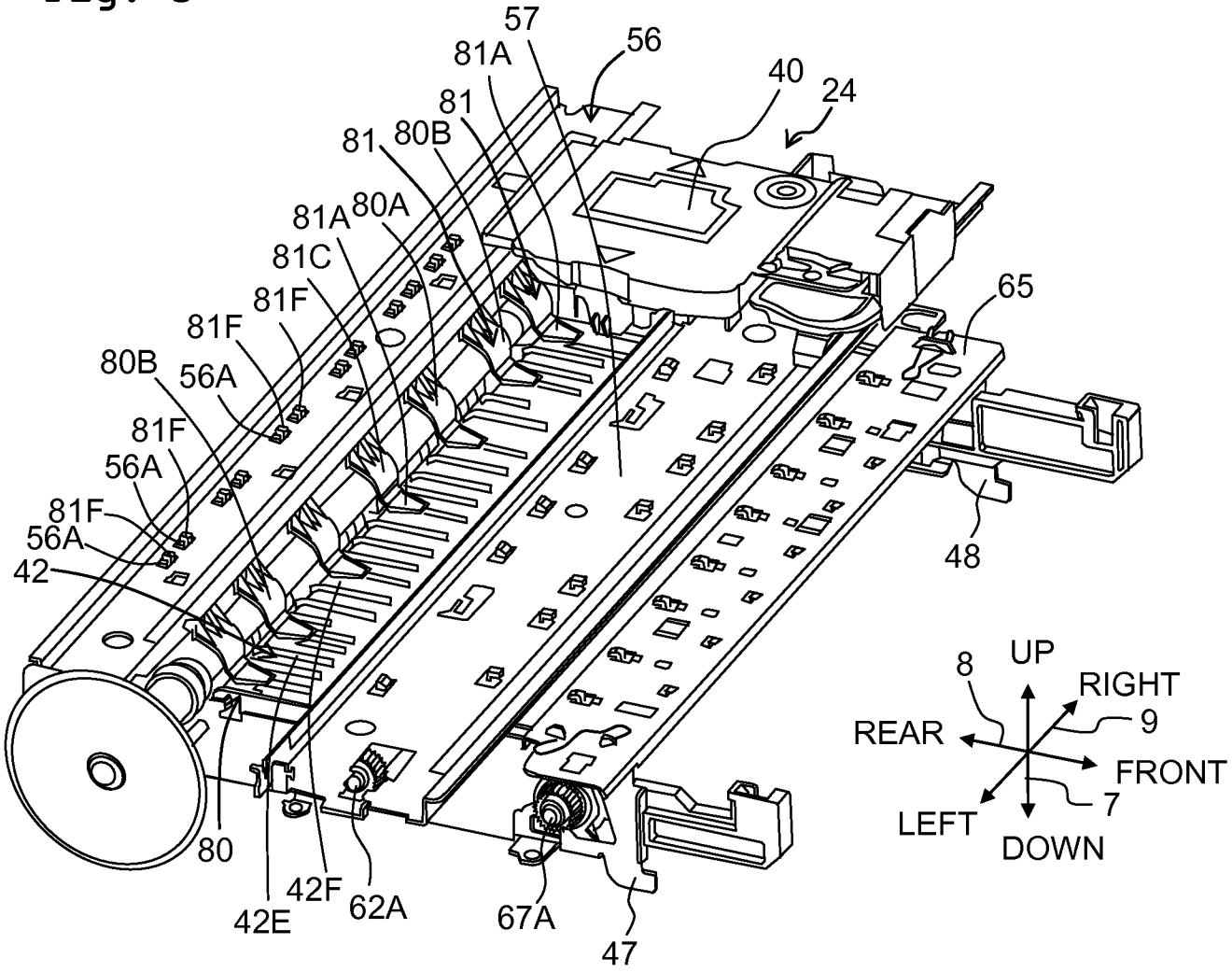
FIG. 3 is a perspective view depicting a recording section, a first guide rail, a second guide rail and those in the vicinity of the recording section and the first and second guide rails in the printer unit.

As depicted in FIG. 3, the printer unit 11 is supported by a left side surface frame 47 and a right side surface frame 48 which are disposed both on the left and right sides, respectively, of a rear portion of the casing 14. Each of the left side surface frame 47 and the right side surface frame 48 is extended in the front-rear direction 8 and the up-down direction 7.

Each of the first guide rail 56 and the second guide rail 57 is supported by the left side surface frame 47 and the light-side surface frame 48 in a state of being placed across the left side surface and right side surface frames 47 and 48. A rear side portion and a front side portion of the carriage 40 in the recording section 24 are slidably supported by the first guide rail 56 and the second guide rail 57, respectively. The carriage 40 is slidably moved on a front side portion on the upper surface of the first guide rail 56.

A roller supporting frame 65 having a strip-plate shape extending in the left-right direction 9 is supported, at a location in front of the second guide rail 57, by the left side surface frame 47 and the right side surface frame 48. The facing roller 68 arranged on the upper side in the reversing roller pair 45 (see FIG. 2) is attached to a lower side of the roller supporting frame 65.

Figure 5:
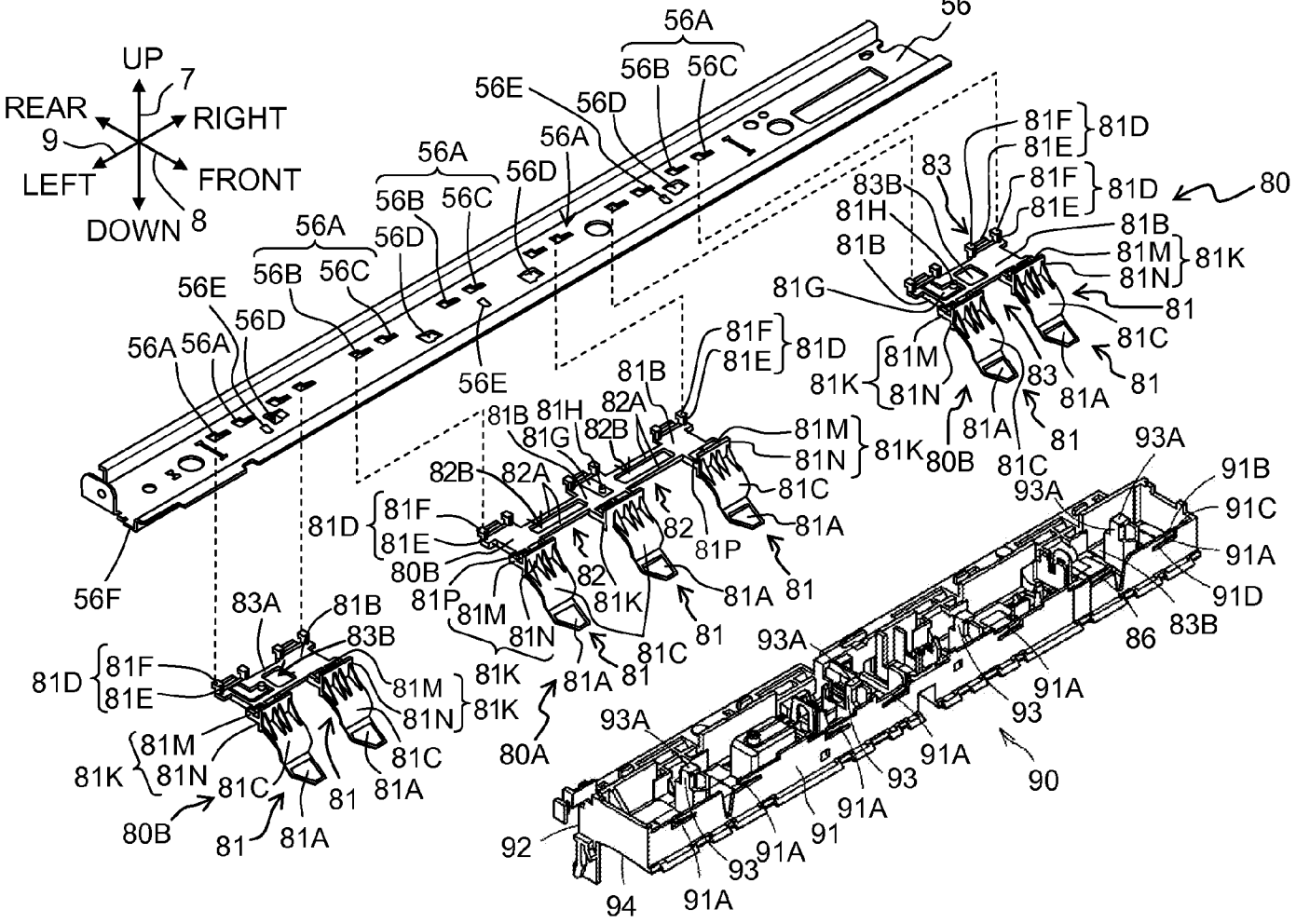
FIG. 5 is an exploded perspective view depicting the first guide rail, the corrugating section and an urging member.

As depicted in FIG. 5, a corrugating section 80, which causes the recording sheet 12 being conveyed to be in a waved state along the left-right direction 9, is disposed on the lower side of the first guide rail 56. The corrugating section 80 has a first abutment member 80A arranged at a central position in the left-right direction 9 and second abutment members 80B arranged both on the left and right sides, respectively, of the first abutment member 80A. An urging member 90 which presses each of the first abutment member 80A and the second abutment members 80B against the first guide rail 56 is disposed on the lower side of the firs guide rail 56. The structures of the corrugating section 80 and the urging member 90 will be described later on.

Figure 4:
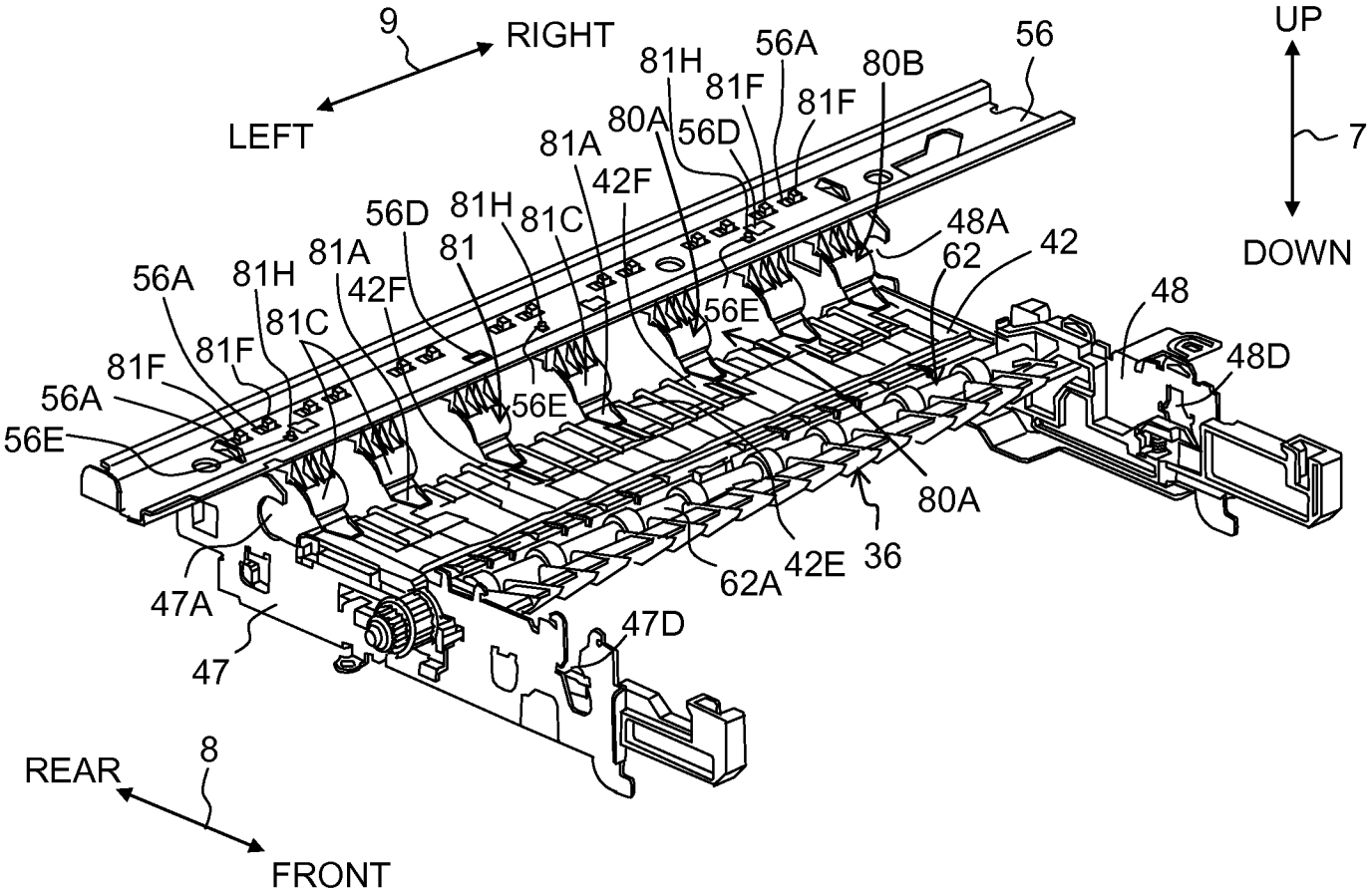
FIG. 4 is a perspective view depicting the first guide rail, a corrugating section, a platen and those in the vicinity of the first guide rail, the corrugating section and the platen.

As depicted in FIG. 4, cutouts 47A and 48B which support a roller shaft 60A of the first conveyance roller 60 (see FIG. 2) are formed in the left side surface frame 47 and the right side surface frame 48, respectively. The first conveyance roller 60 is allowed to be in a state depicted in FIG. 3 under a condition that the roller shaft 60A of the first conveyance roller 60 is rotatably supported by the cutouts 47A and 48A.

As depicted in FIG. 4, both end portions of a roller shaft 62A of the second conveyance roller 62 are supported by the left side surface frame 47 and the right side surface frame 48, respectively. The roller shaft 62A of the second conveyance roller 62 is rotatably supported by supporting hole portions (not depicted in the drawings) formed in the left side surface frame 47 and the right side surface frame 48, respectively, in a state that the roller shaft 62A is movable in the up-down direction 7. The facing roller 63 (see FIG. 2) arranged on the upper side in the second conveyance roller pair 44 is attached to a location below the second guide rail 57 (see FIG. 3).

As depicted in FIG. 4, supporting hole portions 47D and 48D which support both end portions of a roller shaft 67A of the reversing roller 67 are formed in the left side surface frame 47 and the right side surface frame 48, respectively. The roller shaft 67A of the reversing roller 67 is rotatably supported by the supporting hole portions 47D and 48D in a state that the roller shaft 67A is movable in the up-down direction 7. The platen 42 disposed between the first conveyance roller pair 59 and the second conveyance roller pair 44 is supported by the roller shaft 62A of the second conveyance roller 62.

<Platen 42>

As depicted in FIG. 4, the platen 42 has a strip-plate shape extending in the left-right direction 9, and a side edge portion on the front side of the platen 42 is rotatably supported by the roller shaft 62A of the second conveyance roller 62. A rear portion on the upper surface of the platen 42 is provided with abutment areas 42F against which abutment portions 81A in the corrugating section 80 abut, respectively. Each of the abutment areas 42F is a flat surface against which the entirety of the lower surface in each of the flat-shaped abutment portions 81A abut. Further, a plurality of ribs (projections) 42E which project upward and extend in the front-rear direction 8 respectively are arranged on an upper surface of the platen 42 at an appropriate distance from one another in the left-right direction 9. Each of the ribs 42E is disposed at a location different from one of the abutment areas 42F to extend from a side edge portion on the rear side of the platen 42 up to an intermediate area in the front-rear direction 8 of the platen 42.

<Corrugating Section 80>

As depicted in FIG. 5, the first abutment member 80A is attached to a central portion in the left-right direction 9 of the first guide rail (supporting member) 56, and the respective second abutment members 80B both on the left and right sides are attached to the first guide rail 56 in a state that the second abutment members 80B are arranged both on the left and right sides, respectively, of the first abutment member 80A, each at a predetermined distance from the first abutment member 80A. The distances from the respective second abutment members 80B to the first abutment member 80A are identical.

The first abutment member 80A is provided with three abutment bodies 81 arranged in the left-right direction 9 apart from one another, and first connecting portions 82 each connecting adjacent abutment bodies 81 among the three abutment bodies 81.

Each of the abutment bodies 81 has a base section 81B facing the lower surface of the first guide rail 56, a connecting portion 81K disposed on a front end portion (downstream end portion in the conveyance direction of the recording sheet 12) of the base section 81B, a curved section 81C projecting from the front end portion of the connecting portion 81K while curving downward and frontward, and an abutment portion 81A disposed at a lower end portion (forward end portion) of the curved section 81C.

The base section 81B has a flat rectangular-plate shape in a plane view, and a pair of engaging sections 81D which engage with the first guide rail 56 are provided on a rear end portion of the base section 81B. The engaging sections 81D have support post portions 81E projecting upward respectively from both the left and right sides of the base section 81B, and locking portions 81F extending rearward respectively at tip end portions of the support post portions 81E. Each of the support post portions 81E has a rectangular cross-sectional shape of which lengths in the front-rear direction 8 (the conveyance direction of the recording sheet 12) and in the left-right direction 9 are each constant.

The first guide rail 56 is provided with openings 56A to which the engaging sections 81D of each of the base sections 81B are inserted, respectively. Each of the openings 56A is arranged at a rear portion in the first guide rail 56, namely, on the rear side of (behind) a sliding position at which the carriage 40 is slidably moved in the first guide rail 56. Each of the openings 56A has a penetration portion 56B having a dimension allowing one of the locking portions 81F of the base section 81B to penetrate therethrough, and a slide portion 56C extending rightward from a front portion of the penetration portion 56B. The length of the slide portion 56C in the front-rear direction 8 is adjusted to allow the support post portion 81E to penetrate through the slide portion 56C but to prevent the locking portion 81F from penetrating through the slide portion 56C.

The locking portions 81F of the engaging sections 81D are inserted into the penetration portions 56B from therebelow in the openings 56A, respectively, of the first guide rail 56, to thereby allow the respective locking portions 81F to be placed above the first guide rail 56. In such a state, the support post portions 81E are slid rightward along the slide portions 56C of the openings 56A, respectively, thereby positioning the locking portions 81F of the engaging sections 81D above right end portions of the slid portions 56C, respectively. In this state, the locking portions 81F are locked on the upper surface of the first guide rail 56, and are prevented from disengaging (dropping) from the openings 56A.

Among the abutment bodies 81, an abutment body 81 (central abutment body 81) located in the center of the left-right direction 9 is provided with a strip-plate shaped leaf spring section 81G elongated in the front-rear direction 8. The leaf spring section 81G is located at a central portion in the left-right direction 9 of the base section 81B. The leaf spring section 81G is constructed of a strip-plate shaped portion formed in a portion of the base section 81B by forming a cutout in the base section 81B. A boss portion 81H projecting upward is provided on a forward end portion of the base section 81B. As depicted in FIG. 4, the boss portion 81H is fitted into an opening 56E formed in the first guide rail 56 in a state that each of the engaging sections 81D of the base section 81B is engaged with the first guide rail 56. Such a leaf spring section is not provided on the base section 81B of each of the remaining two abutment bodies 81 different from the central abutment body 81.

As depicted in FIG. 5, the connecting portion 81K provided between the base section 81B and the curved section 81C has three connecting bodies 81M and flat-plate shaped attaching portions 81N. The connecting bodies 81M project forward at locations on the front surface of the base section 81B and arranged at a predetermined distance in the left-right direction 9 from one another. The flat-plate shaped attaching portion 81N are supported on front end portions of the connecting bodies 81M respectively along the up-down direction 7 (see FIGS. 8A to 8D depicting modifications of the second abutment member 80B). A projection 81P (see FIG. 6B and FIGS. 8A to 8D) projecting upward so as to contact with the lower surface of the first guide rail 56 is provided on a rear portion in each of the connecting bodies 81M. The attaching portion 81N is supported by the forward end of each of the connecting bodies 81M at an intermediate portion of the attaching portion 81N in the up-down direction 7, so that the attaching portion 81N extends along the up-down direction 7 and the left-right direction 9. A portion of the attaching portion 81N located above each of the connecting bodies 81M extends along the front side-edge portion of the first guide rail 56.

An upper end portion of the curved section 81C is attached to a lower portion on the front surface of the attaching portion 81N. The curved section 81C has a shape of which length in the left-right direction 9 is substantially constant, and has a shape conforming to the outer circumferential portion on the front side of the first conveyance roller pair 59. The curved section 81C has an elasticity to be movable in the up-down direction 7 and the front-rear direction 8.

Each of the abutment portions 81A projects frontward from a lower end portion of the curved section 81C, and has a triangular shape in a plane view of which length in the left-right direction 9 is gradually decreased in the frontward direction. Each of the abutment portions 81A is located upstream in the conveyance direction of the recording sheet 12 relative to the nozzles 39 of the recording section 24. The abutment portions 81A abut against the abutment areas 42F respectively provided in the rear portion on the upper surface of the platen 42, in a state that the recording sheet 12 is not conveyed. When the recording sheet 12 is conveyed, the abutment portions 81A abut against the recording sheet 12.

A front end portion, of the flat-plate shaped abutment portion 81A, on the downstream side in the conveyance direction of the recording sheet 12 is substantially parallel to the recording sheet 12 which is being conveyed. Note that the structure of the abutment portion 81A is not limited to this structure, and the abutment portion 81A may be inclined upward along the conveyance direction of the recording sheet 12 (i.e. to be inclined such that the abutment portion 81A is located at an upper position progressively toward the downstream side in the conveyance direction).

Each of the first connecting portions 82 has a pair of linking portions 82A connecting the base sections 81B of the adjacent abutment bodies 81 with each other. Each of the pair of linking portions 82A is constructed of a linear member elongated in the left-right direction 9 and having a constant length in the front-rear direction 8 (width). A hole 82B of which length in the front-rear direction 8 is constant is defined between the pair of linking members 82A. The hole 82B is an elongated hole defined by the pair of linking portions 82A and the adjacent base sections 81B sandwiching the pair of linking portions 82B therebetween. In a state that the base section 81B is attached to the first guide rail 56, gaps in the up-down direction 7 are defined between the upper surfaces of the linking portions 82A and the lower surface of the first guide rail 56. The length in the front-rear direction 8 of each of the linking portions 82A is shorter than the length in the front-rear direction 8 of each of the support post portions 81E in the engaging sections 81D provided on each of the base sections 81B.

The first connecting portion 82 having such a structure is twisted in the circumferential direction about the axis line in the left-right direction 9, more easily than the base section 81B. For example, in such a case that a rotational force about an axis line 6 (see FIGS. 8A to 8D) in the left-right direction 9 which passes through the central position in the front-rear direction 8 of the first connecting portion 82 is applied to a certain base section 81B among the base sections 81B, the first connecting portion 82 is easily twisted about the axis line 6 by the rotational force, which in turn suppresses the transmission of the rotational force about the axis line 6 to another base section 81B located adjacent to the certain base section 81B.

The first abutment member 80A is formed of a synthetic resin (for example, polyacetal (POM)) in such a manner that the three abutment bodies 81 and two pieces of the first connecting portion 82 are molded as an integrated body.

As depicted in FIG. 5, each of the second abutment members 80B has two abutment bodies 81 and a second connecting portion 83 connecting the two abutment bodies 81 with each other. An abutment body 81 among the two abutment bodies 81 located on the left side has substantially the same structure as that of the abutment body 81 located at the central portion in the first abutment member 80A, except that the abutment body 81 on the left side of the second abutment member 80B has a different shape of the leaf spring section 81G provided on the base section 81B from that in the central abutment body 81 of the first contact member 80A. Namely, the leaf spring section 81G in the second abutment member 80B has such a structure that a front end portion thereof is extended rightward, and a forward end portion of the rightward extended portion is provided with the boss portion 81H. Another abutment body 81 among the two abutment bodies 81 located on the right side in the second abutment member 80B has the same structure as that of the abutment bodies 81 located at the both sides of the central abutment body 81 in the first contact member 80A.

The distance in the left-right direction 9 between the two abutment bodies 81 in the second abutment member 80B is shorter than the distance in the left-right direction 9 between two mutually adjacent contacting bodies 81 in the first abutment member 80A. The second connecting portion 83 of the second abutment member 80B has a pair of linking portions 83A which has a structure substantially similar to that of the pair of linking portions 82A of the first connecting portion 82 of the first abutment member 80A, except that the length in the left-right direction 9 of each of the linking portions 83A is smaller than that of each of the linking portions 82A of the first connecting portion 82 of the first abutment member 80A. The second connecting portion 83 of the second abutment member 80B is also provided with a hole 83B defined by the pair of linking portions 83A and the pair of base sections 81B, and the length in the left-right direction 9 of the hole 83B is shorter than that of the hole 82B in the first connecting portion 82 of the first abutment member 80A.

The second connecting portion 83 having such a structure is twisted about the axis line 6 in the left-right direction 9, more easily than the base sections 81B arranged on the both sides of the second connecting portion 83. For example, in such a case that the rotational force about the axis line 6 is applied to any one of the base sections 81B, the second connecting portion 83 is easily twisted about the axis line 6 by the rotational force. This consequently suppresses the transmission of the rotational force about the axis line 6 to the other of the base sections 81B.

The second abutment member 80B is also formed of a synthetic resin (for example, polyacetal (POM)) in such a manner that the two contacting bodies 81 and the one second connecting portion 83 are molded as an integrated body. Note that each of the first and second abutment members 80A and 80B is not limited to the integrally molded structure, and each may be structured by, for example, fitting a plurality of members or components with respect to each other.

<Urging Member 90>

Figure 6B:
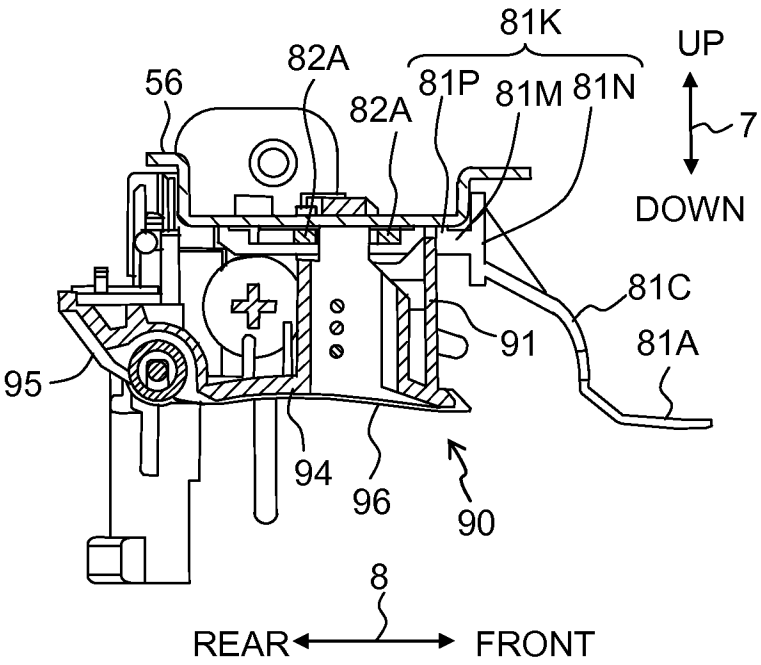
FIG. 6A and FIG. 6B are cross-sectional views each depicting the first guide rail and the corrugating section.
Figure 6A:
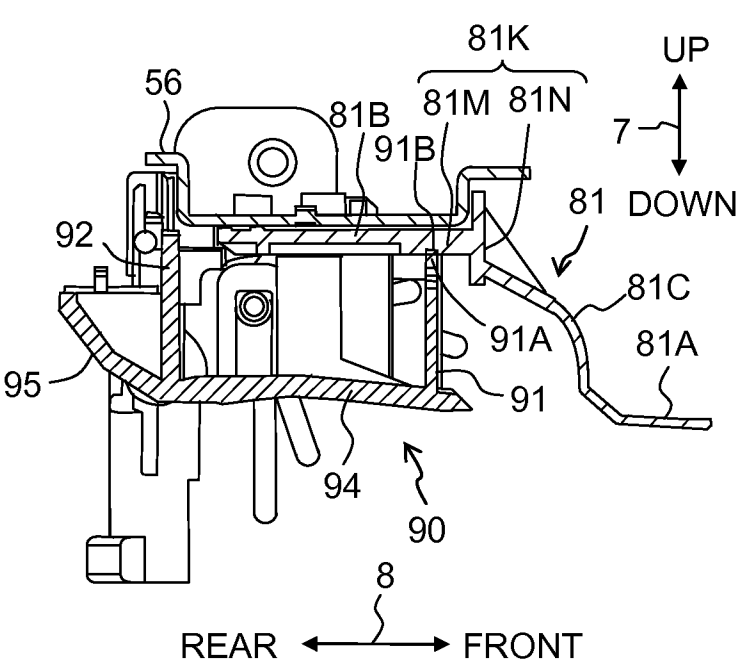

As depicted in FIGS. 5, 6A, and 6B, the first abutment member 80A and the second abutment members 80B are pressed from below by the urging member 90 in a state that the first and second abutment members 80A and 80B are supported by the first guide rail 56. The urging member 90 is formed in a substantially box-like shape having a front wall 91 and a rear wall 92 which extend in the left-right direction 9, and the upper portion of the urging member 90 is open.

Figure 7A:
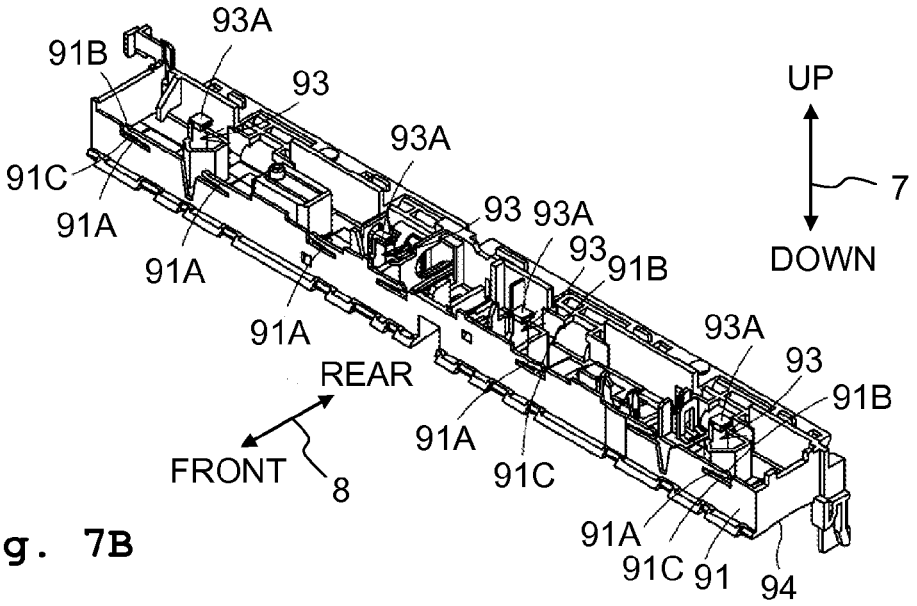
FIG. 7A is a perspective view of the urging member as seen from above.

As depicted in FIG. 7A, a plurality of urging sections 91A are arranged at an upper edge portion of the front side wall 91, apart from one another in the left-right direction 9. Each of the urging sections 91 is located at a position below the base section 81B of one of the abutment bodies 81 in the first or second abutment members 80A or 80B, and each of the urging sections 91A is formed to have a plate spring-like shape extending in the left-right direction 9. One end in the longitudinal direction (the left-right direction 9) of each of the urging sections 91A is integrally formed with the front side wall 91. On the other hand, a space 91C is defined at a location outside the other end (forward end portion) in the longitudinal direction (the left-right direction 9) of the urging section 91A and below the urging section 91A. Owing to such a structure, a tip end portion of each of the urging sections 91A is displaceable in the up-down direction 7, and has elasticity.

Pressing portions 91B projecting upward are provided on the tip end portions of the urging sections 91A, respectively. Each of the pressing portions 91B abuts against a central portion in the left-right direction 9 at a front portion of the base section 81B of one of the abutment bodies 81 to thereby press the front portion in the base section 81B upward.

As depicted in FIG. 7A, the urging member 90 is provided with four support members 93 via which the urging member 90 is supported by the first guide rail 56. The support members 93 project upward from an intermediate portion in the front-rear direction 8 of a bottom plate 94 of the urging member 90, respectively at locations with a predetermined distance in the left-right direction 9 from one another. An upper end portion of each of the support members 93 is provided with an engaging portion 93A extending frontward. Note that the number of the support member 93 is not limited to four pieces.

As depicted in FIG. 5, the first guide rail 56 is formed with four engaging holes 56D along the left-right direction 9 at an intermediate portion in the front-rear direction 8 of the first guide rail 56, and on the rear side of (behind) the sliding position of the carriage 40. The engaging holes 56D are arranged at locations corresponding to the four support members 93, respectively. A left side-portion of each of the engaging holes 56D has a dimension allowing the engaging portion 93A provided on the upper end of one of the support members 93 to penetrate through the left side-portion, and right side-portion of each of the engaging holes 56D has a dimension allowing a lower portion of the engaging portion 93A to penetrate through the right side-portion but preventing the engaging portion 93A as a whole from penetrating through the right-side portion. Namely, the engaging portions 93A can be engaged with the upper surface of the first guide rail 56 by inserting the engaging portions 93A of the support members 93 into the left side-portions of the engaging holes 56D, respectively, so as to position the engaging portions 93A to a position above the first guide rail 56, and then by sliding the support members 93 rightward. By allowing the engaging portions 93A of all of the engaging members 93 to be engaged with respect to the upper surface of the first guide rail 56, the urging member 90 is supported by the first guide rail 56.

In a state that the urging member 90 is supported by the first guide rail 56, the pressing portion 91B of each of the urging sections 91A provided on the front side wall 91 is pressed against the front portion of the base section 81 in one of the abutment bodies 81. With this, the projection 81P of the connecting portion 81K of each of the abutment bodies 81 is pressed against the lower surface of the first guide rail 56. The engaging sections 81D provided on the rear portion of each of the base sections 81B are engaged with the first guide rail 56. Accordingly, when the projection 81P of the connecting portion 81K located in front of each of the base sections 81B is pressed against the lower surface of the first guide rail 56, the curved section 81C of each of the contacting bodies 81 is thereby bent (deformed) such that the abutment portion 81A located at the lower end of the curved section 81C is lifted upward. As a result, the forward end portion of the abutment portion 81A is displaced upward, and the abutment section 81A is allowed to have a state that the abutment section 81A is substantially parallel to the recording sheet 12 which is being conveyed, or is inclined upward relative to the conveyance direction of the recording sheet 12.

Figure 7B:
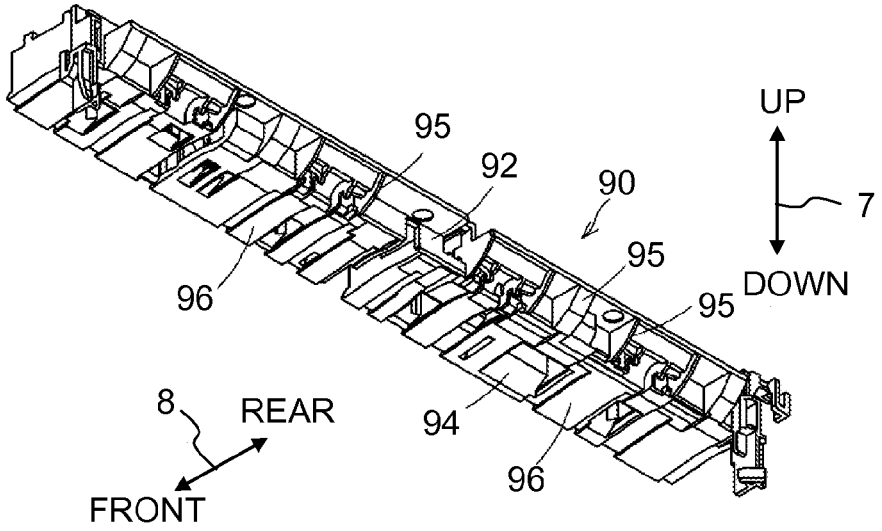
FIG. 7B is a perspective view of the urging member as seen from below.

As depicted in FIG. 7B, a plurality of first guide members 95 projecting rearward are provided, along the front-rear direction 8, at a lower portion of a rear wall 96 of the urging member 90. The plurality of first guide members 95 are arranged apart from one another in the left-right direction 9. A rear edge portion of each of the first guide members 95 is inclined upwardly and rearwardly, so that the rear end portion of each of the first guide members 95 is located at a height corresponding to an intermediate position in the up-down direction 7 in the rear wall 92. The first guide members 95 guide the recording sheet 12 conveyed from the first conveyance route 33 to a position below the bottom plate 94 of the urging member 90.

The lower surface of the bottom plate 94 is provided with second guide members 96 which guide the recording sheet 12 guided by the first guide members 95 to the first conveyance roller pair 59. The urging member 90 is molded of a resin as an integrated member, and thus the rear wall 92 and the first guide members 95, and the bottom plate 94 and the second guide members 96 are formed integrally.

<Operation of Corrugating Section 80 and Urging Member 90>

In a case that the recording sheet 12 in the feeding tray 20 is conveyed from the first conveyance route 33 to the first conveyance roller pair 59 based on the center reference, the recording sheet 12 is guided by the first guide members 95 and the second guide members 96 of the urging member 90, and is conveyed onto the platen 42. In this situation, when the recording sheet 12 being conveyed by the first conveyance roller pair 59 abuts against the abutment portions 81A of the respective abutment bodies 81 in the first abutment member 80A, the recording sheet 12 against which the abutment portions 81A abut is pressed against the contact areas 42F in the platen 42. The ribs 42E along the front-rear direction 8 are provided both on the left and right sides of the contacting areas 42F, respectively. Thus, portions, of the recording sheet 12, against which the abutment portions 81A abut respectively are located below and away from the recording section 24 than other portions of the recording sheet 12 against which the ribs 42E abut, respectively. With this, the portions of the recording sheet 12 pressed against the contact areas 42F by the abutment portions 81A, respectively, are curbed or waved to protrude downward.

In this situation, the reaction force from the recording sheet 12 is applied to the respective abutment portions 81A of the abutment bodies 81 in the first abutment member 80A. This reaction force moves or displaces the abutment portions 81A upward, thereby providing a state in which the curved sections 81C are displaced upward. With this, the front end portions of the base sections 81B are also displaced upward. In this situation, the first connecting portions 82 each of which connects the adjacent contacting bodies 81 are constructed by the pair of linking portions 82A having the hole 82B formed therebetween. Thus, even when any one of or both of the adjacent abutment bodies 81 is/are deformed, the first connecting portion 82 is twisted so as to rotate about the axis line 6. With this, in a case that any one of the adjacent abutment bodies 81 on the both sides of the first connecting portion 82 is displaced, any displacement of the other of the adjacent abutment bodies 81, that would otherwise be caused by the displacement of the one of the adjacent abutment bodies 81, is suppressed. This suppresses any change in the pressing force, with which the abutment portion 81A of the other of the abutment bodies 81 presses the recording sheet 12, that would otherwise be caused by the displacement of the one of the adjacent abutment bodies 81.

The above operation is the same also regarding the second abutment members 80B. When the abutment portions 81A abut against the recording sheet 12, portions in the recording sheet 12 against which the abutment portions 81A abut are pressed against the contact areas 42F, respectively, in the platen 42, thereby providing a state that the recording sheet 12 is waved. In this case also, even when any one of the abutment bodies 81 on the both sides of the second connecting portion 83 is displaced, any displacement of the other of the abutment bodies 81, that would otherwise be caused by the displacement of the one of the abutment bodies 81, is suppressed by the second connecting portion 83.

In such a manner, the abutment areas 42F in the platen 42, the respective ribs 42E arranged both on the left and right sides of each of the abutment areas 42F, and the abutment portions 81A facing or opposite to the abutment areas 42F cooperate to provide the waved state to the recording sheet 12. As a result, the recording sheet 12 is allowed to be waved along the left-right direction 9. Afterwards, the waved portion of the recording sheet 12 is stopped at a predetermined position in the platen 42, and an image, etc. is recorded on the recording sheet 12 by the recording section 24. In this case, the waved state imparted to the recording sheet 12 makes it possible to suppress any occurrence of the cockling in the recording sheet 12 on which the image, etc. is to be formed with the ink droplets.

EFFECTS OF THE EMBODIMENT

According to the embodiment, in a case that the abutment portions 81A of the respective contacting bodies 81 in the first and second abutment members 80A and 80B abut against the recording sheet 12, the displacement of the respective contacting bodies 81 is absorbed by the first and second connecting portions 82, 83. Accordingly, the abutment body 81 adjacent to any displaced abutment portions 81A is hardly displaced as well. With this, a desired pressure can be imparted to the recording sheet 12 by the abutment portion 81A of each of the abutment bodies 81, thereby making it possible to impart a desired waved state to the recording sheet 12 along the left-right direction 9.

In the first and second abutment members 80A and 80B, the engaging sections 81D provided on the base section 81B of each of the abutment bodies 81 are engaged with the first guide rail 56, and each of the first connecting portion 82 and the second connecting portion 83 connects the adjacent base sections 81B with each other. With this, the first abutment member 80A and the second abutment members 80B can be easily attached to predetermined locations, respectively, in the first guide rail 56.

Gaps in the up-down direction 7 are defined between the first guide rail 56 and each of the first and second connecting portions 82 and 83. Accordingly, the twisting of each of the first and second connecting portions 82 and 83 is hardly hindered by any contact with the first guide rail 56.

Each of the first and second connecting portions 82 and 83 has a portion of which length in the front-rear direction 8 is shorter than the length of each of the engaging sections 81D in the front-rear direction 8. With this, in a case that any one of the abutment portions 81A on the both sides of each of the first and second connecting portions 82 and 83 abut against the recording sheet 12, each of the first and second connecting portions 82 and 83 can be easily twisted.

Further, since each of the first connecting portions 82 has the hole 82B and each of the second connecting portions 83 has the hole 83B, each of the first and second connecting portions 82 and 83 can be easily twisted. In a case that the hole 82B of each of the first connecting portions 82 and the hole 83B of each of the second connecting portions 83 are elongated holes defined by the linking portions 82A and 83A, respectively, each of the first and second connecting portions 82 and 83 can have the twisted state more easily.

Since the length in the left-right direction 9 of the hole 82B in the first connecting portion 82 is longer than the length in the left-right direction 9 of the hole 83B in the second connecting portion 83, each of the first and second connecting portions 82 and 83 has a twisted state suitable for positions at which the abutment portions 81A abut against the recording sheet 12.

Since the first guide frame 56 supports the recording section 24 to be movable in the left-right direction 9, a space for arranging the first and second abutment members 80A and 80B can be made small.

Each of the first and second abutment members 80A and 80B is integrally molded with a synthetic resin. With this, the first and second abutment members 80A and 80B can be easily produced.

The recording section 24 records an image, etc., on the recording sheet 12 by discharging ink droplets from the nozzles 39 onto the recording sheet 12. This makes it possible to improve the quality of the image, etc., formed by the ink droplets.

The abutment portions 81A are located upstream of the nozzles 39 in the conveyance direction. With this, it is possible to prevent any cockling of a recording sheet on which an image, etc. is formed with the ink droplets.

First Modification

Figure 8A:
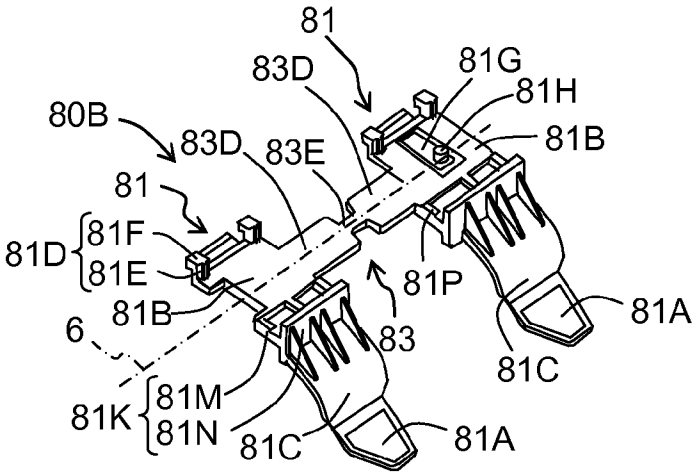
FIG. 8A, FIG. 8B, FIG. 8C, and FIG. 8D are perspective views of modifications of a second abutment member in the present teaching.

FIG. 8A depicts a first modification in the second connecting portion 83 of the second abutment member 80B. The second connecting portion 83 is constructed of flat-plate shaped connecting bodies 83D projecting respectively from base sections 81B in the abutment bodies 81 both on the left and right sides, toward a central portion in the left-right direction 9 of the second connecting portion 83, and a connecting portion 83E connecting the connecting bodies 83D on the left and right sides to each other. Each of the connecting bodies 83D has a same shape, and central portions of the connecting bodies 83D in the front-rear direction 8 are connected to each other by the connecting portion 83E. The length in the front-rear direction 8 of the connecting portion 83E is shorter than the length in the front-rear direction 8 of each of the connecting bodies 83D. When the rotational force about the axis line 6 is applied to an end portion, of the second connecting portion 83, on either one of the left and right sides, the second connecting portion 83 can easily have a twisted state about the axis line 6 as the center, due to the applied rotational force. Accordingly, even when either one of the abutment bodies 81 is displaced, it is possible to suppress any change in the pressing force, with which the abutment portion 81A of the other of the abutment bodies 81 presses the recording sheet 12, that would otherwise be caused by the displacement of the one of the abutment bodies 81. The first connecting portion 82 of the first abutment member 80A may also have a similar structure as described above regarding the second connecting portion 83 of the second abutment member 80B.

Second Modification

Figure 8B:
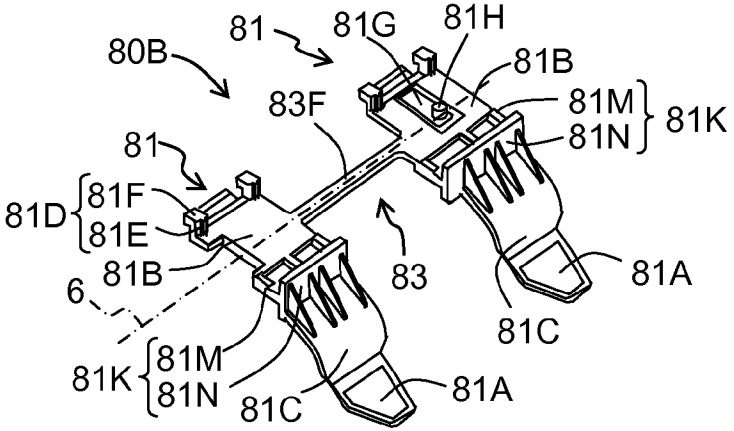

As depicted in FIG. 8B, the second connecting portion 83 of the second abutment member 80B in a second modification is constructed of a single linking portion 83F. The linking portion 83F is formed of a linear member having a constant width, and connects central portions in the front-rear direction 8 of the base sections 81B in the abutment bodies 81 both on the left and right sides. The center line along the left-right direction 9 of the linking portion 83F is substantially coincident with the axis line 6. Also with such a structure, even when either one of the abutment bodies 81 is displaced, it is possible to suppress any change in the pressing force, with which the abutment portion 81A of the other of the abutment bodies 81 presses the recording sheet 12, that would otherwise be caused by the displacement of the one of the abutment bodies 81. The first connecting portion 82 of the first abutment member 80A may also have a similar structure as described above regarding the second connecting portion 83 of the second abutment member 80B.

Third Modification

Figure 8C:
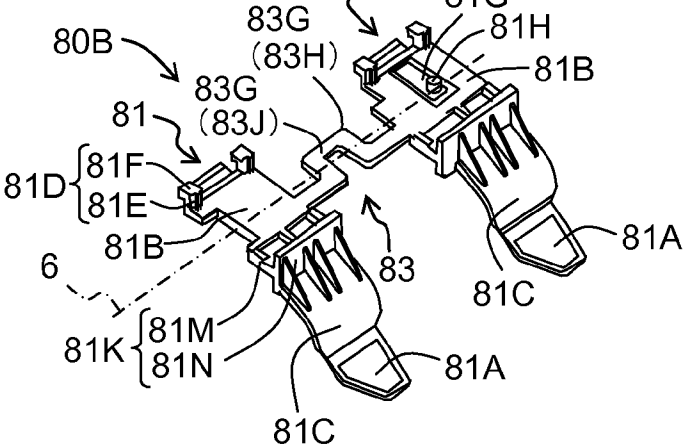

As depicted in FIG. 8C, the second connecting portion 83 of the second abutment member 80B in a third modification is constructed of a linking portion 83G having a shape obtained by bending a single linear member having a constant width. The linking portion 83G projects from front portions of the base sections 81B of the abutment bodies 81, toward a central portion in the left-right direction 9 of the second connecting portion 83, and a bent portion 83H which is located at the central portion in the left-right direction 9 of the second connecting portion 83 is bent to protrude rearward. A rear portion in the bent portion 83H is a linear portion 83J along the left-right direction 9, and the central axis along the left-right direction 9 in the linear portion 83J is substantially coincident with the axis line 6. Also with such a structure, even when either one of the abutment bodies 81 is displaced, it is possible to suppress any change in the pressing force, with which the abutment portion 81A of the other of the abutment bodies 81 presses the recording sheet 12, that would otherwise be caused by the displacement of the one of the abutment bodies 81. Note that the bent portion 83H may project frontward. The first connecting portion 82 of the first abutment member 80A may also be configured in a similar manner as described above regarding the second connecting portion 83 of the second abutment member 80B.

Fourth Modification

Figure 8D:
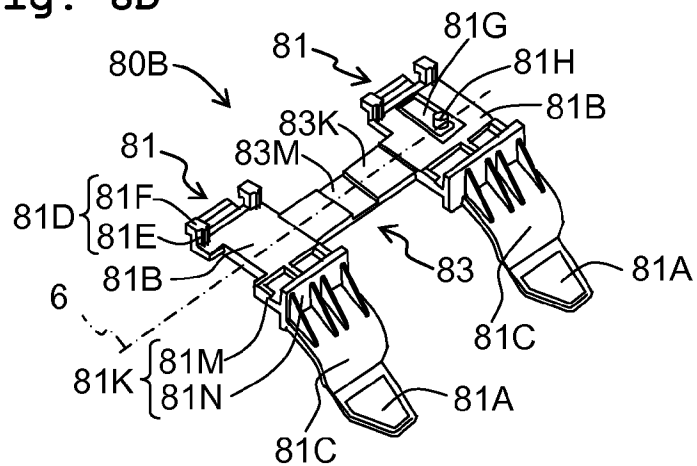

As depicted in FIG. 8D, the second connecting portion 83 of the second abutment member 80B in a fourth modification is constructed of a strip plate-shaped linking plate 83K having a constant width. The length in the front-rear direction 8 of the linking plate 83K is made to be constant, and the central line passing through a central portion in the front-rear direction 8 in the linking plate 83K is substantially coincident with the axis line 6. A recessed portion 83M along the front-rear direction 8 is formed in a central portion in the left-right direction 9 of the linking plate 83K. The recessed portion 83M is open upward. Accordingly, the thickness of the central portion in the left-right direction 9 of the linking plate 83K is thinner than the remaining portion of the linking plate 83K different from the central portion. Also with such a structure, even when either one of the abutment bodies 81 is displaced, it is possible to suppress any change in the pressing force, with which the abutment portion 81A of the other of the abutment bodies 81 presses the recording sheet 12, that would otherwise be caused by the displacement of the one of the abutment bodies 81. The first connecting portion 82 of the first abutment member 80A may also have a similar structure as described above regarding the second connecting portion 83 of the second abutment member 80B.

Other Modifications

The structure of the abutment bodies 81 of each of the first and second abutment members 80A and 80B is not limited to the structure for curving (corrugating) the recording sheet 12, and may be such a structure capable of abutting against the recording sheet 12 from above, to thereby suppress any floating of the recording sheet 12 from the platen 42. In this case, there is provided a structure in which the ribs 42E are not provided on the platen 42, or a structure in which each of the abutment portions 81A is always arranged above the abutment areas 42F between the ribs 42E of the platen 42.

The first and second abutment members 80A and 80B are arranged upstream of the recording section 24 in the conveyance direction of the recording sheet 12. It is allowable, however, to arrange the first and second abutment members 80A and 80B downstream of the recording section 24 in the conveyance direction of the recording sheet 12.

Further, the corrugating section 80 is constructed of three abutment members, namely, the first abutment member 80A and the two second abutment members 80B. It is allowable, however, that the corrugating section 80 is constructed of a single abutment member in which these three abutment members are connected to one another. In this case, all of the first and second connecting portions 82 and 83 can be molded integrally.

Further, the first conveyance route 33 and the second conveyance route 34 each have a structure wherein the recording sheet 12 is conveyed based on the center reference and an image, etc., is recorded on the recording sheet 12 based on the center reference. It is allowable, however, that each of the first conveyance route 33 and the second conveyance route 34 is provided with such a structure wherein the recording sheet 12 is conveyed based on one side (single side) reference, with either one of side edge positions in the recording sheet 12 in the width direction, which is orthogonal to the conveyance direction of the recording sheet 12, as the reference. In this case, an image is recorded on the recording sheet 12 based on the single side reference, with one of the side edges in the width direction of the recording sheet 12 as the reference.

What is claimed is:

1. An image recording apparatus comprising:

a recording section configured to record an image on a sheet conveyed in a conveyance direction in a conveyance route; and an abutment member having a plurality of abutment portions which are arranged apart from each other in a width direction orthogonal to the conveyance direction so that the plurality of abutment portions abut against the sheet convened in the conveyance route respectively, and a connecting portion connecting adjacent abutment portions among the plurality of abutment portions, wherein the connecting portion is configured to twist around an axis of twist extending in the width direction, under a condition that the plurality of abutment portions abuts against the sheet, wherein the recording section is configured to record the image on the sheet by discharging ink droplets from nozzles onto the sheet, and wherein the plurality of abutment portions are located upstream of the nozzles in the conveyance direction.

2. The image recording apparatus according to claim 1, further comprising a supporting member configured to support the abutment member, wherein:

the abutment member has a plurality of engaging sections which are arranged apart from each other in the width direction to correspond to the plurality of abutment portions, respectively, each of the engaging sections abuts against and is engaged with the supporting member, and the connecting portion connects adjacent engaging sections among the plurality of engaging sections.

3. The image recording apparatus according to claim 2, wherein a gap is defined between the connecting portion and the supporting member.

4. The image recording apparatus according to claim 2, wherein the connecting portion has a portion of a length, in the conveyance direction, shorter than a length of each of the engaging sections in the conveyance direction.

5. The image recording apparatus according to claim 1, wherein the connecting portion has a hole formed between the adjacent abutment portions.

6. The image recording apparatus according to claim 5, wherein the connecting portion has a plurality of linking portions arranged apart from each other in the conveyance direction and each extending in the width direction, and wherein the hole is an elongated hole defined by the linking portions and extending in the width direction.

7. The image recording apparatus according to claim 5, wherein:

the abutment member is included in a plurality of abutment members provided along the width direction, the number of the abutment portions included in one abutment member among the plurality of abutment members is greater than the number of the abutment portions included in another abutment member among the plurality of abutment members, and the hole in the connecting portion of the one abutment member has a length, in the width direction, greater than a length, in the width direction, of the hole in the connecting portion of another abutment member among the plurality of abutment members.

8. The image recording apparatus according to claim 7, wherein:

the plurality of abutment members include a central abutment member and side abutment members, the central abutment member being arranged at a central location of the conveyance route in the width direction, one of the side abutment members being arranged at a first side location of the conveyance route in the width direction, and another of the side abutment members being arranged at a second side location of the conveyance route in the width direction, and the hole in the connecting portion of the central abutment member has a length, in the width direction, greater than a length, in the width direction, of the hole in the connecting portion of each of the side abutment members.

9. The image recording apparatus according to claim 1, wherein:

the connecting portion is formed to have a flat-plate shape, and in relation to the conveyance direction, a length of a central portion of the connecting portion in the width direction is smaller than a length of another portion of the connecting portion.

10. The image recording apparatus according to claim 1, wherein the connecting portion is constructed of a single linking portion.

11. The image recording apparatus according to claim 10, wherein the linking portion is bent so that a central portion in the width direction of the linking portion is projected in the conveyance direction or a direction opposite to the conveyance direction.

12. The image recording apparatus according to claim 10, wherein the linking portion is extended in the width direction.

13. The image recording apparatus according to claim 1, wherein:

the connecting portion has a linking portion formed to have a flat-plate shape, and a thickness of a central portion in the width direction of the linking portion is smaller than a thickness of another portion of the linking portion.

14. The image recording apparatus according to claim 2, wherein the supporting member is configured to support the recording section to be movable in the width direction.

15. The image recording apparatus according to claim 1, wherein the abutment member is integrally molded with a synthetic resin.

16. The image recording apparatus according to claim 1, further comprising a pair of rollers configured to nip the sheet therebetween and convey the sheet in the conveyance direction, wherein the pair of rollers is provided upstream of the recording section in the conveyance direction, and wherein the plurality of abutment portions is positioned downstream of a nip point of the pair of rollers in the conveyance direction.

17. An image recording apparatus comprising:

a recording section configured to record an image on a sheet conveyed in a conveyance direction in a conveyance route;

an abutment member having a plurality of abutment portions which are arranged apart from each other in a width direction orthogonal to the conveyance direction so that the plurality of abutment portions abut against the sheet convened in the conveyance route respectively, and a connecting portion connecting adjacent abutment portions among the plurality of abutment portions; and a platen provided below the recording section and configured to support the sheet, wherein the connecting portion is configured to twist around an axis of twist extending in the width direction, under a condition that the plurality of abutment portions abuts against the sheet, wherein each downstream end of the plurality of abutment portions in the conveyance direction are positioned at a space between the recording section and the platen.

* * * * *